US005115604A

United States Patent [19]

Bunyard

[11] Patent Number: 5,115,604

[45] Date of Patent: May 26, 1992

[54] DEVICE FOR ATTACHING TWO BUILDING STRUCTURES TOGETHER

[76] Inventor: Robert Bunyard, Bob Bunyard Tile Co., 500 Upton St., Redwood City, Calif. 94062

[21] Appl. No.: 557,366

[22] Filed: Jul. 24, 1990

Related U.S. Application Data

[62] Division of Ser. No. 343,431, Apr. 26, 1989, Pat. No. 4,993,201.

[51] Int. Cl.[5] ..... A47K 3/16; A47K 3/22; E04B 1/00

[52] U.S. Cl. ..... 52/34; 52/284; 52/346; 52/479; 52/35; 4/614

[58] Field of Search ..... 52/272, 284, 347, 345, 52/346, 479–481, 34–35, 264, 265; 4/596–601, 614

[56] References Cited

U.S. PATENT DOCUMENTS

| | | | |
|---|---|---|---|
| 1,349,850 | 8/1920 | Patterson | 52/265 X |
| 1,622,983 | 3/1927 | Tracy | 52/265 |
| 4,462,193 | 7/1984 | Ericson | 52/264 X |
| 4,655,011 | 4/1987 | Borges | 52/34 X |

*Primary Examiner*—David A. Scherbel
*Assistant Examiner*—Kien Nguyen
*Attorney, Agent, or Firm*—Julian Caplan

[57] ABSTRACT

Panels which are assembled to form a stall shower are prefabricated. Each panel has a facing of tile adhered to a plywood backing. On the rear of the backings are elongated vertical ribs. The lower edges of the ribs are notched to interfit with a shower base. The upper edges are notched to interfit with a shower ceiling. The outer edges of the ribs are either attached to studding or are covered with wallboard. The panels comprise four corners, a back, two sides and two door jambs. In addition to the shower base and ceiling, additional members include a shower door curb and a header.

2 Claims, 4 Drawing Sheets

DEVICE FOR ATTACHING TWO BUILDING STRUCTURES TOGETHER

This is a division of application Ser. No. 343,431 filed 4/26/89 now U.S. Pat. No. 4,993,201.

BACKGROUND OF THE INVENTION

1. Field of the Invention

This invention relates to a new and improved stall shower and, more particularly, to an assembly of preformed panels, each faced with tiles which interfit and interlock in such manner that the assembly may be rapidly completed at the site in a watertight manner.

2. Description of Related Art

Prefabricated cast stall shower enclosures of a one-piece variety are well known in the art. Further, preassembled enclosures, wherein the panels are assembled at a factory and delivered to a site are also known. These types of enclosures are difficult to install and also to transport.

Although prefabricated panels which are assembled at the site are also known in the art, the present invention has considerable advantages thereover in the sense that rapid assembly is improved in accordance with the present invention.

SUMMARY OF THE INVENTION

The present invention comprises a shower base which supports four corner panels, a back and two side panels, and two jamb panels at the entrance opening. The back and side panels are anchored to studs which surround the shower enclosure. A header and curb, as well as a cover, are also provided. Each of the vertical panels interlocks with a panel support rim around the shower base. Further, the several panels interlock with respect to each adjacent panel in a manner hereinafter described in detail. Wallboard is attached to the studs and to the jamb panel frames.

By proceeding in a fixed order of assembly, within a very short period of time, workmen may assemble the panels at the site, all as hereinafter appears.

Other objects of the present invention will become apparent upon reading the following specification and referring to the accompanying drawings in which similar characters of reference represent corresponding parts in each of the several views.

IN THE DRAWINGS

FIG. 1A is a perspective view, partially broken away to reveal internal construction of a stall shower and its enclosure.

FIG. 1B an exploded perspective view of the panels used in the present invention.

FIG. 2 an enlarged perspective view of an exterior corner of the enclosure.

DESCRIPTION OF PREFERRED EMBODIMENT

Figure 1A:
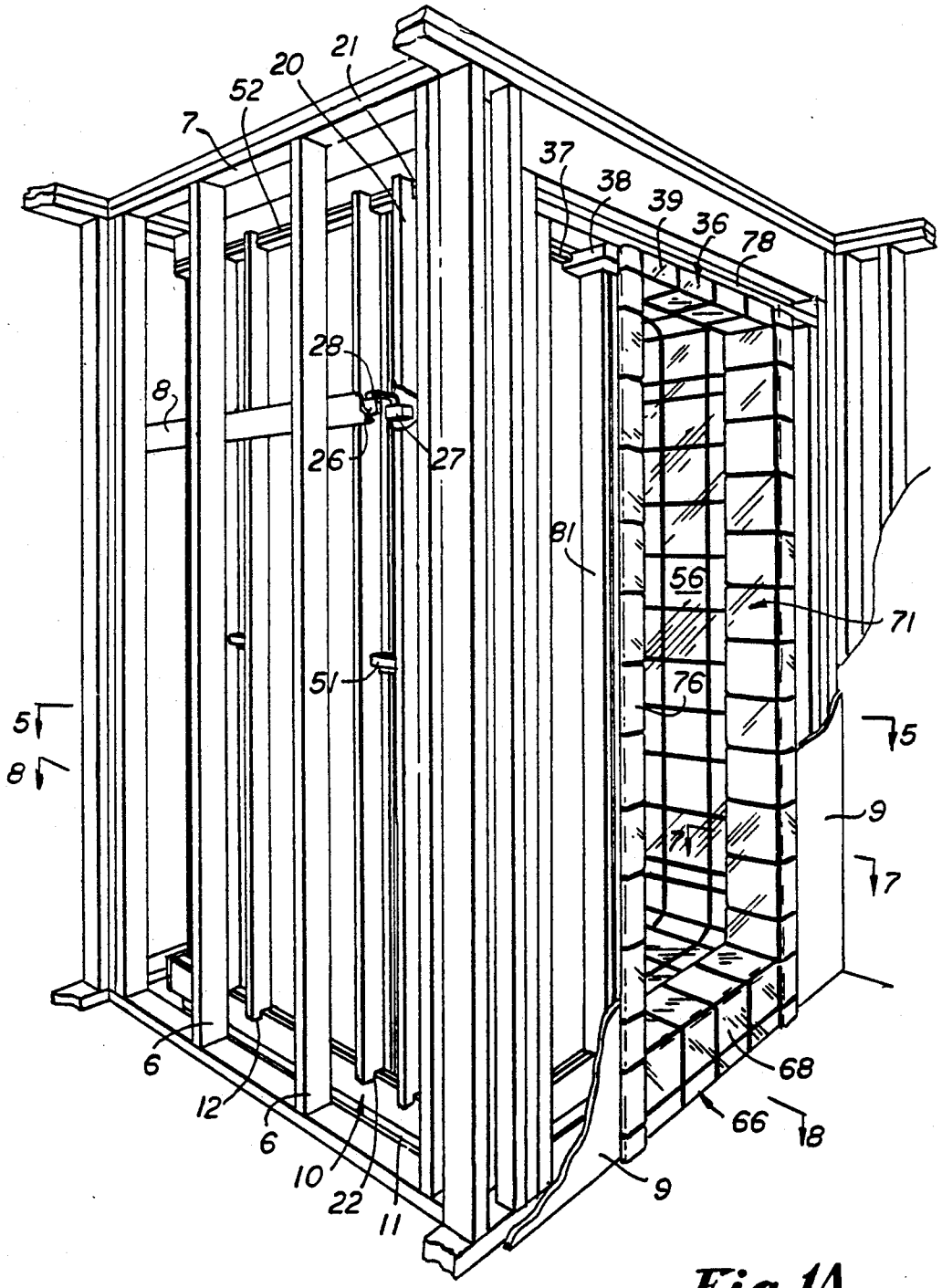
Figure 1B:
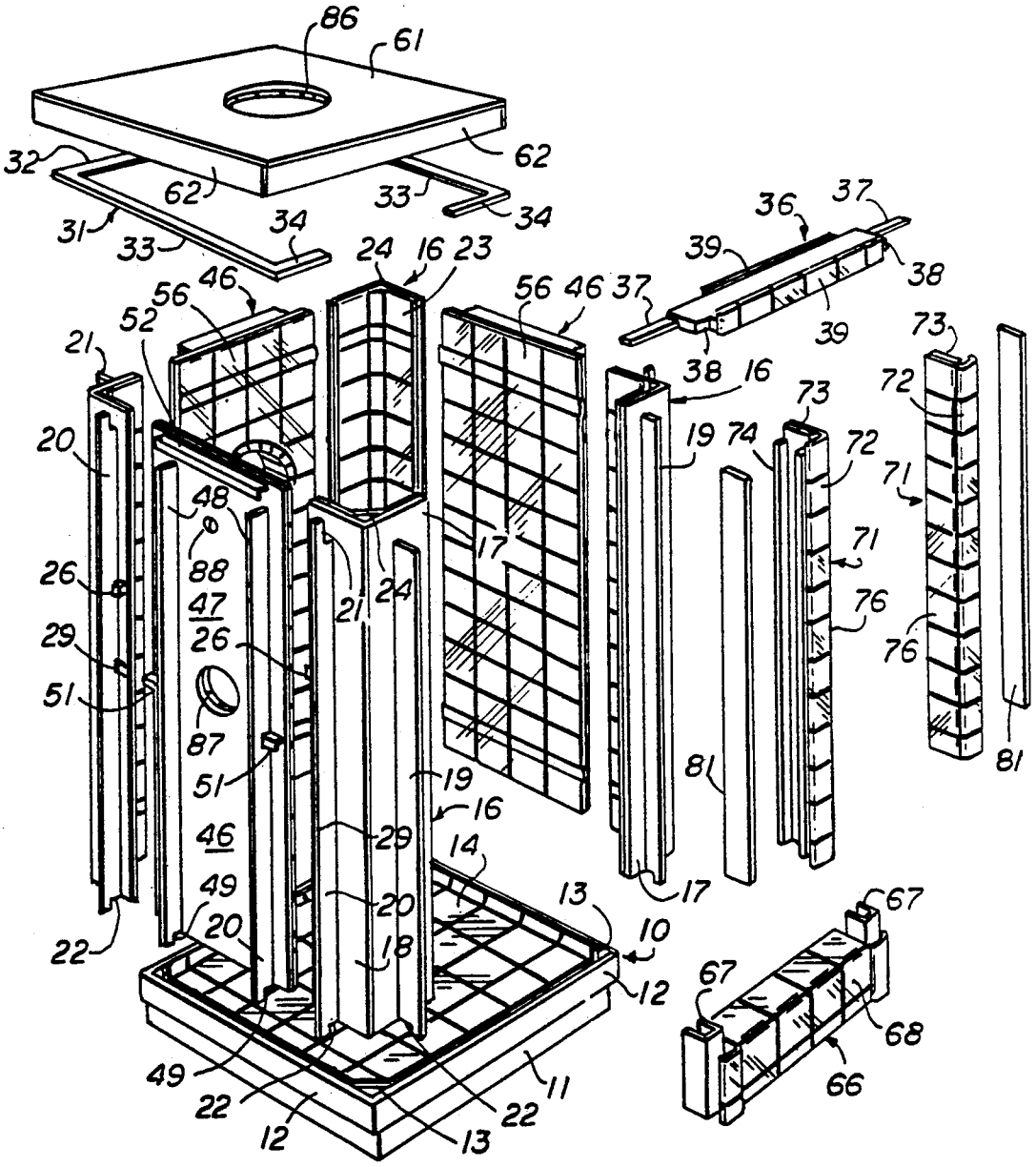
Figure 2:
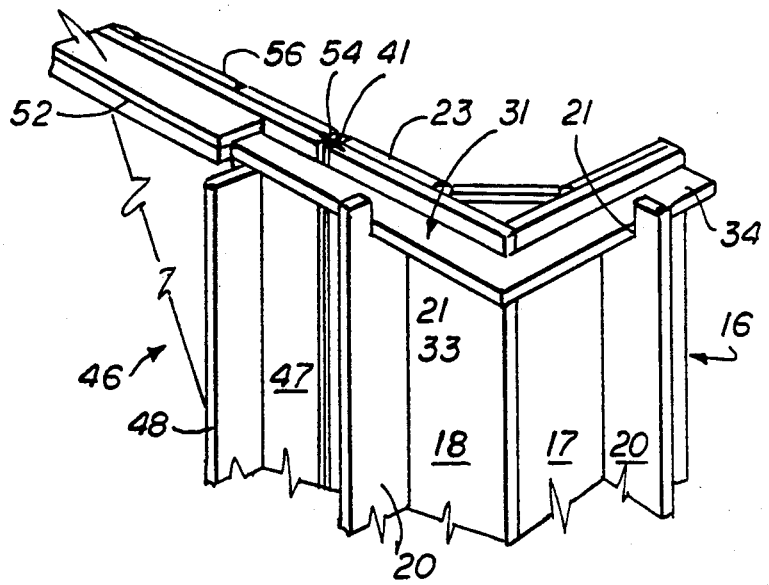

The shower enclosure is installed in a bathroom in a location which varies depending on the design of the building. FIG. 1A shows a typical installation in a corner of the room. The enclosure surrounds three sides (typically) and comprises studs 6 which extend between floor and ceiling plates 7. Horizontal battens 8 are nailed to studs 7 at a specific height for a purpose which is hereinafter explained. After the shower is completed, wallboard 9 is fastened to studs 6 in exposed locations.

Shower base 10 has a rectangular bottom base or plate 11 which rests on the flooring of the bathroom. Surrounding the perimeter of plate 11 are vertically upward extending panel supports 12. The corners 13 within the supports 12 are left open in a preferred embodiment so that the interior of the stall may be coved, but this is an optional feature. Tile 14 covers the upper surface of plate 11 and the interior of supports 12. Drain 15 is installed in the bottom of the floor of the shower.

Figure 3:
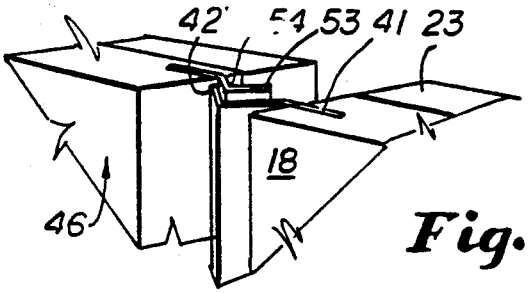
FIG. 3 is a further enlarged fragmentary perspective view showing the interlock of adjacent vertical edges of panels.
Figure 4:
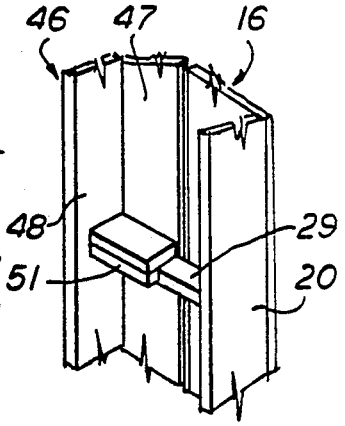
FIG. 4 is a fragmentary enlarged perspective view of an interlock of adjacent panels.

At each of the four corners is a corner panel 16, the four corners being essentially the same except for one feature which is hereinafter explained. Each is formed of emulsion-coated material, the side edges of which receive V-grooved extensions 41 and 53 (see FIG. 3). First corner backing panel 17 and second corner backing panel 18 at right angles thereto are assembled. On the front of the enclosure there are vertical ribs 19 which terminate below the top edge of the backing panel 17. All of the other sides of the four corners 16 have vertical side ribs 20. Each of the ribs 20 is formed with a top notch 21 which is on the top inner edge of the rib and all of the ribs 19 and 20 are formed with bottom notches 22 which are at the bottom inner corner thereof. The various panels and ribs are rectangular, having vertical edges and top and bottom ends.

The first step in assembly of the enclosure is to install each of the corners 16 so that the notches 22 fit over the top edges of the panel supports 12 as a means to secure the lower ends of the ribs to the panel supports.

Figure 5:
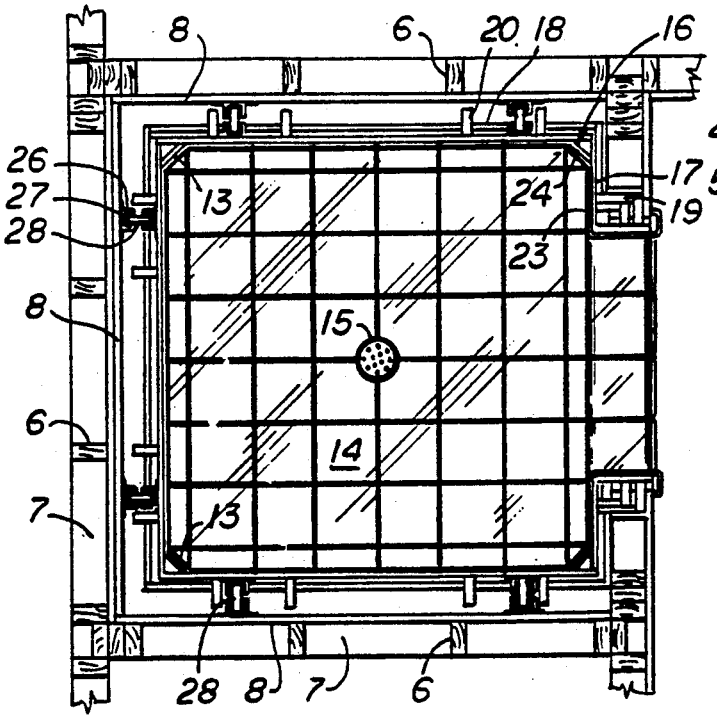
FIG. 5 is a horizontal cross-sectional view taken substantially along line 5—5 of FIG. 1A.
Figure 6:
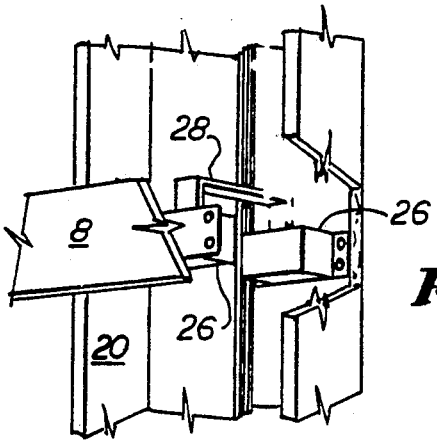
FIG. 6 is a fragmentary perspective view showing anchoring of the shower panels to surrounding framework.
Figure 7:
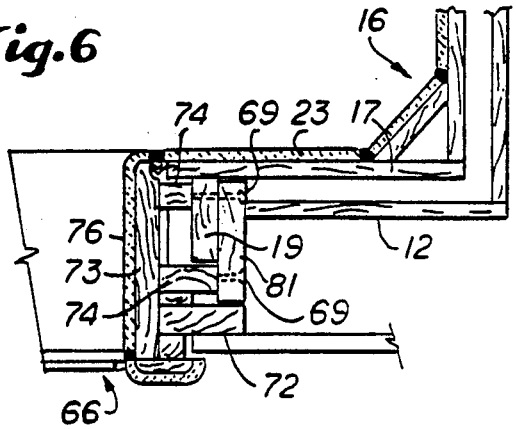
FIG. 7 is a horizontal sectional view taken substantially along line 7—7 of FIG. 1A.
Figure 9:
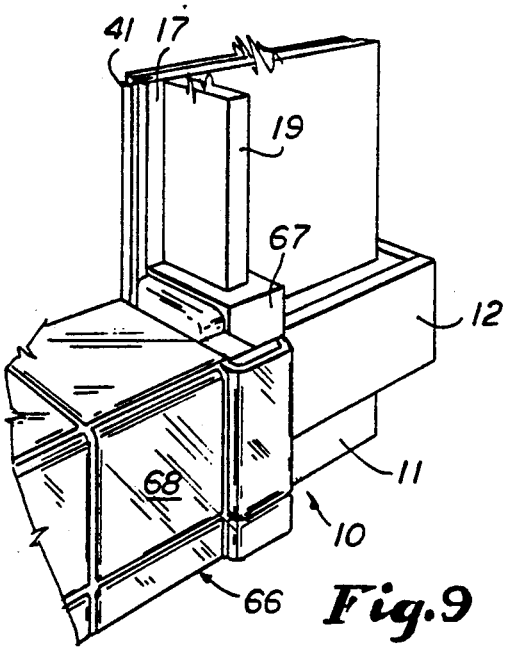
FIG. 9 is a fragmentary perspective view of the curb of the shower opening.

Further features of corners 16 comprise tile lining 23 on the inside thereof which has coved corners 24 matching the shower base tile 14. At appropriate places on backing 17 or 18 are installed anchor cups 26. Similar anchor cups 26 are secured to battens 8 on the adjacent studs 6 (See FIGS. 5 and 6) A cement-like adhesive 27 is filled in the cups 26. Thereupon an inverted U-shaped anchor is pushed into the adhesive 27 as a means to engage the vertical edges of the back, side and corner backing panel to each other. When the adhesive 27 sets, the corners 16 are anchored to the studding of the bathroom. Another feature of each corner 16 is a horizontal lug on each backing 18 or 19 (except for the front corners). As hereinafter explained, the lugs 29 are means to assist in locking the corners to the sides and back.

A top locking collar 31 is supplied having a back 32, sides 33 and inward extending fronts 34. The locking collar is inserted into the notches 21 of the four corners 16 and rests on and is secured to the top edges of the front ribs 19.

To complete the locking of the top edges of the corner, a header 36 is provided. Such a header has outward extensions 37 which overlap and are secured to the fronts 34 of collar 31. Notches 38 are formed in the outer corners of header 36 to provide for interlocking with the jambs as hereinafter explained. Tile 39 covers the bottom of header 36 and the inner and outer faces thereof inside notches 38.

The vertical edges of backings 17 and 18 (except for the front backings 17) have inserted therein metal extensions 41 (best shown in FIG. 3), the extensions 41 being formed with V-shaped grooves 42.

Side and back panels 46 are substantially identical, each having a backing panel 47. Vertical ribs spaced inward from the vertical edges of backing 47 are provided and are formed at the bottom ends with notches 49 facing inward. Receptors 51 are secured to backing 47 outwardly of ribs 48 and these receptors fit over the lugs 29 of corner panels 16. A downward facing top interlock 52 is provided on the upper edge of each panel 46 and this fits over and engages either the back 32 or sides 33 of top collar 31.

The vertical edges of backings 47 are provided with metal extensions 53 similar to extensions 41 also formed with V-grooves 54. Preliminary to installation of the panels 46, the grooves are filled with silicone adhesive. The panels are fitted together by the V-grooves 54, 42 interfitting and the panels are then slid downward about one-half inch until the receptors 51 fit over the lugs 29 and the top interlock 52 fits over the collar 31.

It will be understood that the panels 46 are faced with tile 56 which matches and lines up with the tile in corner panels 16.

Ceiling 61 has sides 62 which fit over the top ends of backings 17, 18 and 47, resting on the top of interlocks 52. The interior of ceiling 61 is lined with tile (not shown).

Figure 8:
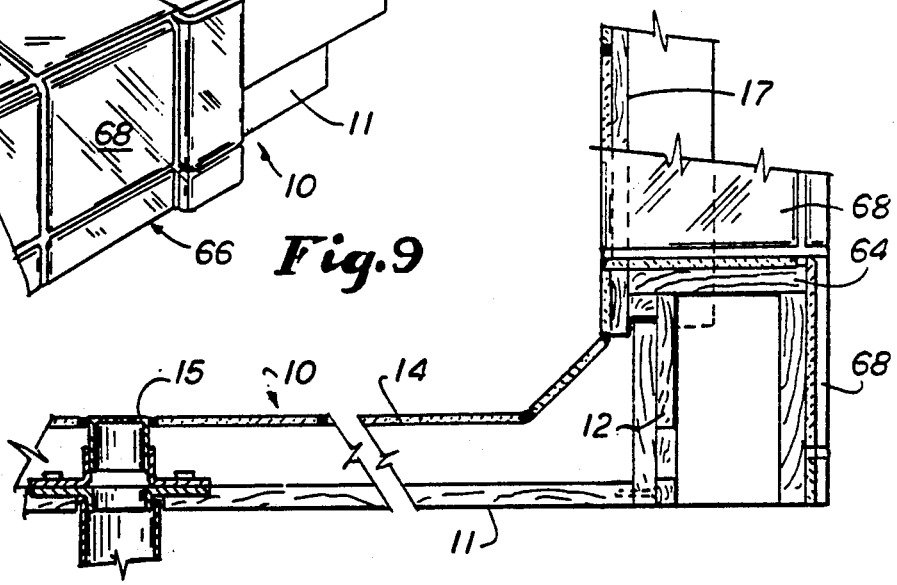
FIG. 8 is a horizontal sectional view taken substantially along line 8—8 of FIG. 1A.

Curb 66 comprises a frame 64, shown in FIG. 8 as being L-shaped, over which tiles 68 are adhered on the top inside and outside surfaces. Two inward facing vertical channels 67, higher than the tiles 68, are attached to the frame on either side and receive front ribs 19. The curb is locked down on the forward panel support 12 by fasteners 69. The curb is well caulked.

Right and left jambs 71 have front and side supports 72, 73. Vertical rib 74 is affixed to the side support 73 near the rearward edge thereof. Tiles 76 cover the exterior. The jamb is secured in place by means of screws 69 in the nearest face 17 of the corner panel. Jamb locking panel 81 is positioned against ribs 74 with the jamb side 73 resting against it. The locking panel is pushed back against the corner secured to the rib. Screws are screwed into the front of the locking panel to secure to the jamb, pulling the jamb tight against the rib.

A two-by-four 78 is placed on top of the header 36 and cut to span between the vertical studs of an alcove which has been pre-built for the shower enclosure. Thereupon sheetrock 9 is installed on the face of the alcove, sliding the same carefully behind the tile in the front of the shower. Sheetrock is secured to all of the studs 6 which are exposed.

It will be understood that a hole 86 may be formed in the ceiling 61 for a lighting fixture, if desired. Holes 87 and 88 are formed in one of the side panels for the water valve and shower spout, respectively.

The foregoing series of steps in the assembly of the device should be followed with care and grouting used to insure that a watertight enclosure is obtained.

What is claimed is:

1. In combination, a first building frame member, a second building frame member spaced from said first member, a first upward-opening cup discrete from said first member, first means attaching said first cup to said first member, first adhesive in said first cup, a second upward-opening cup discrete from said second member, second means attaching said second cup to said second member, second adhesive in said second cup, and an inverted U-shaped rigid member having vertical legs fitting into and retained by the adhesives in said cups.

2. The combination of claim 1 in which said adhesive is cement-like.

* * * * *